United States Patent [19]

Lowes

[11] Patent Number: 4,959,972

[45] Date of Patent: Oct. 2, 1990

[54] WIDE RANGE REFRIGERATION SYSTEM WITH SUCTION GAS COOLING

[75] Inventor: Albert R. Lowes, Roseville, Calif.

[73] Assignee: Mydax, Inc., Auburn, Calif.

[21] Appl. No.: 402,668

[22] Filed: Sep. 5, 1989

[51] Int. Cl.[5] ..... F25B 5/00

[52] U.S. Cl. ..... 62/200; 62/513

[58] Field of Search ..... 62/113, 197, 198, 199, 62/200, 513

[56] References Cited

U.S. PATENT DOCUMENTS

| | | | |
|---|---|---|---|
| 2,020,860 | 11/1935 | Touborg | 62/513 X |
| 2,116,100 | 5/1938 | Cracknell | 62/513 X |
| 2,221,062 | 11/1940 | Starr | 62/513 X |
| 2,665,560 | 1/1954 | Hubbard | 62/513 X |
| 3,730,263 | 5/1973 | Anderson | 165/86 |
| 4,137,726 | 2/1979 | Watada | 62/196 |
| 4,299,664 | 11/1981 | Smith | 202/170 |
| 4,347,702 | 9/1982 | Tawse | 60/618 |
| 4,382,370 | 5/1983 | Suefuji et al. | 62/324 |
| 4,457,137 | 6/1984 | Kohzuma | 62/158 |
| 4,640,100 | 2/1987 | Goldstein | 62/197 |
| 4,833,893 | 5/1989 | Morita | 62/113 |

OTHER PUBLICATIONS

Tecumseh Service Data Book, revised 1984, Tecumseh Products Company, p. 3.

*Primary Examiner*—Harry B. Tanner

*Attorney, Agent, or Firm*—David B. Harrison

[57] ABSTRACT

A refrigerant-compression temperature regulation system providing for suction gas cooling includes: (a) a compressor for compressing the refrigerant in vapor and gaseous phase; (b) a condenser downstream from the compressor for condensing the compressed refrigerant to liquid phase; (c) a first valve downstream from the condenser for creating a predetermined pressure drop; (d) a first evaporator downstream from the first valve for transferring heat between a load and the refrigerant; (e) a suction gas return line leading from the first evaporator to the compressor for returning heated refrigerant to a suction inlet of the compressor; and, (f) a first indirect heat exchanger having a suction gas cooling path from the first valve to upstream of the first evaporator, the first indirect heat exchanger for passively transferring heat from the gas and vapor phase refrigerant in the suction gas return line to the vapor phase refrigerant entering the first evaporator.

3 Claims, 1 Drawing Sheet

WIDE RANGE REFRIGERATION SYSTEM WITH SUCTION GAS COOLING

FIELD OF THE INVENTION

The present invention relates to refrigeration systems and methods. More particularly, the present invention relates to a refrigeration and heating system using a liquid-gas phase coolant over a wide temperature range without reversing condenser/evaporator flow paths and while providing suction gas cooling by passive heat exchange.

BACKGROUND OF THE INVENTION

The advantages of operating a refrigeration system compressor continuously for wide ranging thermal loads without cycling are set forth in my U.S. Pat. No. 4,742,689, reference to which is made for further particulars. One drawback of the system described in that system was the possibility that the refrigerant bypass valve which opened to bypass liquid phase refrigerant directly into the suction line would become stuck open with the most undesirable consequence that incompressible liquid-phase refrigerant entered the suction inlet of the compressor and led to catastrophic destruction of the compressor by a process known in the art as "slugging".

In some industrial heating and cooling applications, such as with chillers applied within plasma etching processes, the present state of the art is to provide refrigeration equipment for cooling and electrical elements for heating. There are numerous drawbacks to this hybrid approach. The first drawback is that the hybrid approach is very inefficient and wastes valuable energy. Heat generated in the refrigeration compressor is wasted, particularly in a system which uses continuous compressor operation as disclosed in the referenced U.S. Pat. No. 4,742,689. A second drawback is that industrial safety specifications increasingly require thermal protection devices to protect against overheating by the electrical heating element. It is very difficult to fit the electrical tank heaters with thermal protection devices which will work reliably to protect against thermal overload.

SUMMARY OF THE INVENTION WITH OBJECTS

A general object of the present invention is to provide an improved refrigerant compression refrigeration system which provides for passive suction gas cooling in a manner which overcomes limitations and drawbacks of the prior art.

A more specific object of the present invention is to provide a continuously operating cooling and heating system which is operable over a wide temperature range with varying loads and which effectively transfers compressor heat to the load to be heated and which effectively transfers refrigerant cooling developed by the compressor to cool the load as heating and cooling conditions change within a process.

One more specific object of the present invention is to provide a refrigeration system which effectively cools suction gas by heat exchange to refrigerant in the vapor phase upstream of the load evaporator.

In accordance with the principles of the present invention, a refrigerant-compression temperature regulation system includes: (a) a compressor for compressing the refrigerant in vapor and gaseous phase; (b) a condenser downstream from the compressor for condensing the compressed refrigerant to liquid phase; (c) a first valve downstream from the condenser for creating a predetermined pressure drop; (d) a first evaporator downstream from the first valve for transferring heat between a load and the refrigerant; (e) a suction gas return line leading from the first evaporator to the compressor for returning heated refrigerant to a suction inlet of the compressor; and, (f) a first indirect heat exchanger having a suction gas cooling path from the first valve to upstream of the first evaporator, the first indirect heat exchanger for passively transferring heat from the gas and vapor phase refrigerant in the suction gas return line to the vapor phase refrigerant entering the first evaporator.

In one aspect of the present invention the refrigerant-compression temperature regulation system further includes a solenoid valve between the condenser and the first valve, the solenoid valve being opened in response to temperature of the load above a predetermined setpoint, and further comprising a second valve downstream of the condenser and a second indirect heat exchanger having a suction gas cooling path from the second valve to upstream of the first evaporator, the second indirect heat exchanger for passively transferring heat from the gas and vapor phase refrigerant in the suction gas return line means to the vapor phase refrigerant entering the evaporator means when the solenoid valve is closed.

In a further aspect of the present invention, the refrigerant-compression temperature regulation system further includes an exhaust gas heat exchanger located between an exhaust gas outlet of the compressor and the condenser and having a heat exchange path in the refrigerant path between the second indirect heat exchanger and the first evaporator for transferring heat from the compressor to the load within the first evaporator.

In one more aspect of the present invention the refrigerant-compression temperature regulation system further includes a second evaporator in the refrigerant path between the second indrect heat exchanger and the exhaust gas heat exchanger for converting the refrigerant passing therethrough to gaseous phase before it passes through the exhaust gas heat exchanger, so that heating of the load may thereby be extended to a higher temperature range.

These and other objects, advantages, aspects and features of the present invention will be more fully understood and appreciated by considering the following detailed description of a preferred embodiment, presented in conjunction with the accompanying drawings.

BRIEF DESCRIPTION OF THE DRAWINGS

In the Drawings:

The FIGURE is a schematic diagram of a continuously operating heating/cooling system incorporating a compressed gas phase/liquid refrigerant medium which provides suction gas cooling in accordance with the principles of the present invention.

DETAILED DESCRIPTION OF A PREFERRED EMBODIMENT

Figure 1:
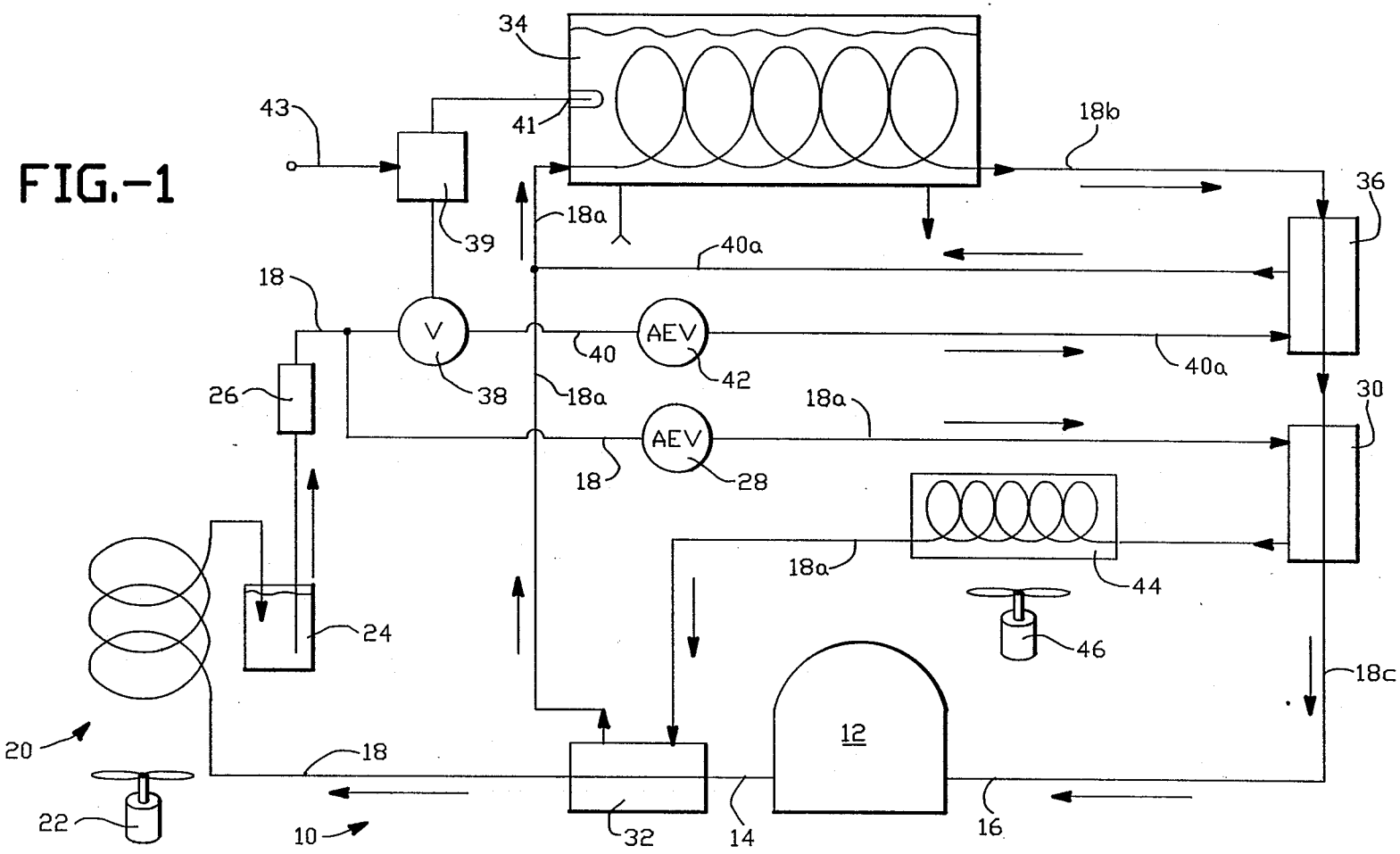

A refrigeration system 10 incorporating suction gas cooling in accordance with the principles of the present invention is depicted in the Figure. Therein, the system 10 includes a compressor 12 having a hot gas outflow 14 and a suction gas inlet 16. The hot gas outflow 14 leads through a hot gas heat exchanger 32 to a main refrigerant loop 18. The main loop 18 passes through a condenser 20 which may include an electric fan 22 for promoting heat exchange with ambient air passing over the coils of the condenser 20. The main loop 18 also passes through a receiver 24 and a filter/drier 26 and through a first automatic expansion valve 28.

At this point in the system 10, a pressure drop occurs and high pressure liquid refrigerant thereupon transitions to its vapor phase with resultant cooling. To designate this first change in phase of the refrigerant in the main loop, the main loop at this point is labelled with reference numeral 18*a*.

The main loop 18*a* next passes through a first suction gas cooling heat exchanger 30. The main loop 18*a* then continues through the exhaust gas heat exchanger 32 to the inlet of an evaporator 34, shown in the Figure as a liquid containing tank. Heat transfer from the liquid body in the tank 32 is transferred to the refrigerant passing through the coils of the evaporator 34 to a degree of evaporation and heating of the refrigerant determined by the amount of heat to be transferred, i.e. the load presented by the evaporator 34.

After the evaporator 34, the main path is labelled 18*b* to indicate that the refrigerant has now completed its heat absorption work at the evaporator 34 and is at a hot temperature and is also at a low pressure. The main loop 18*b* then passes through a second suction gas heat exchanger 36 and then the first suction gas heat exchanger 30. At this point the gaseous refrigerant in the path 18*b* is cooled by the heat exchangers 36 and 30 and the path with cooled suction gas is now labelled 18*c*. This cooled suction gas path 18*c* leads directly to the suction inlet 16 of the compressor 12.

The system 10 may further include a solenoid valve 38 in the liquid path 18. A path 40 leading downstream from the solenoid valve 38 passes through a second automatic expansion valve 42 where a pressure drop occurs with consequent cooling. This cooling is directed by the path 40*a* through the second suction gas heat exchanger 36 and back to a junction with the path 18*a* upstream of the evaporator 34. A solenoid controller 39 compares actual temperatures of the load within the evaporator tank 34 via a temperature sensor 41 with setpoint temperature received over a line 43.

When the solenoid valve 38 is open, refrigerant in liquid phase passes to and through the second automatic expansion valve 42 which is functioning as a pressure regulator. Basically, the valve 42 is set to a high pressure, such as that corresponding to 12 degrees Centigrade which is at the high end of a high temperature compressor, such as the compressor 12. The setting of the second valve 42 is higher than the setting of the first automatic expansion valve 28. At the nominal high pressure, the first valve 28 will be closed, and the only refrigerant path will be through the second valve 42 which leads via the path 40*a* through the second suction gas heat exchanger 36 to the main path 18*a* and to the evaporator 34.

In an operating condition wherein the evaporator has a light heat exchange load, a relatively low super heat is present in the vapor-phase refrigerant passing therethrough. In this condition, the liquid in the evaporator heat exchange tank 34 is at a low temperature, such as 15 degrees Centigrade. The pressure drop through the second suction gas heat exchanger 36 may amount to the equivalent of 2 to 3 degrees Centigrade. In this condition the vapor pressure-temperature equivalence means that the temperature of the refrigerant passing through the second suction gas heat exchanger 36 on the path 40*a* and the temperature of the refrigerant leaving the evaporator 34 are about the same, i.e. about 15 degrees Centigrade. No significant heat exchange is occurring at the second suction gas heat exchanger 36.

In a second operating condition, the evaporator 34 is very hot, and the temperature of the refrigerant leaving the evaporator via the path 18*b* is at a high temperature, such as 70 degrees Centigrade, and the temperature of the refrigerant leading into the second suction gas heat exchanger 36 on the path 40*a* remains at 12–15 degrees Centigrade. In this condition, there is a 55 to 58 degrees Centigrade temperature difference, and very significant heat transfer occurs from the suction gas in the path 18*b* to the refrigerant in the path 40*a*. In this condition the temperature of the refrigerant on the path 18*b* as it exits the second suction gas heat exchanger 36 will be approximately 22 degrees Centigrade. The difference between the temperature of the rerigerant leaving the valve 42 on the path 40*a* and the temperature of the refrigerant leaving the exchanger 36 on the path 18*c* is 10 degrees Centigrade superheat. A suction gas with 10 degrees superheat is very acceptable to protect the compressor 12 from overheating.

In a third operating condition, the load in the evaporator tank 34 has just reached operating temperature and thereupon the solenoid valve 38 closes, stopping flow of refrigerant over the path 40. The pressure of the refrigerant on the suction return path 18*c* drops, causing the expansion valve 28 to open. The valve 28 is set to a different and lower temperature than was the valve 42, such as zero degrees Centigrade. In this situation, refrigerant in vapor phase leaving the valve 28 pass over the path 18*a* and through the first suction gas heat exchanger 30 and thereby cool the suction gas in the path 18*c*. The vapor-phase refrigerant leaving the exchanger 30 on the path 18*a* then passes through the exhaust gas exchanger 32 where it is converted into a warm gas on the path 18*b* which is injected into the evaporator 34 and which will gradually heat the thermal load contained therein. The warm suction gas on the path 18*b* is unaffected by its passage through the first suction gas heat exchanger 36 since the solenoid valve is closed. The superheat of the suction gas is now controlled by the first suction gas heat exchanger 30. With suction gas entering the exchanger 30 at about 40 degrees Centigrade and leaving the exchanger at about 22 degrees Centigrade, the refrigerant flowing from the valve 28 at zero degrees Centigrade will be warmed within the heat exchanger to about 10 degrees Centigrade. In this situation suction gas superheat will remain at about 18 degrees Centigrade, well within the thermal capability of the compressor 12.

To summarize from the three operating conditions presented hereinabove, if the suction gas is not hot to begin with, there is no significant heat exchange in either exchanger 30 or exchanger 36. If the suction gas is very hot, superheat does rise, but very slowly. With moderate sized heat exchangers for the exchangers 30 and 36, load temperatures within the evaporator tank 34 may be controllably varied over a wide temperature range e.g. from −20 to +80 degrees Centigrade.

A second evaporator 44 may be placed in the main path 18*a* between the suction gas exchanger 30 and the exhaust gas exchanger 32. This evaporator 44 may be cooled by a fan 46 so that the vapor-phase refrigerant present in the path 18*a* is completely gassified as it enters the exhaust gas heat exchanger 32. With the refrigerant fully gassified, it may be warmed up to a much higher temperature within the exchanger 32, thereby enabling the load within the first evaporator 34 to be warmed to a higher temperature, thereby extending the thermal range of the system 10 at the high temperature end thereof.

The system 10 eliminates any direct injection of liquid refrigerant into the suction gas as was proposed in the referenced U.S. Pat. No. 4,742,689 and provides a completely passive method and apparatus for suction gas cooling within a continuously operating very wide temperature range refrigeration system.

Those skilled in the art will appreciate that TEVs may be substituted for the solenoid valve and AEVs of system 10 with satisfactory results. To those skilled in the art to which the present invention relates, many widely differing embodiments and applications will be suggested without departure from the spirit and scope of the present invention. The disclosures and description herein are presented for purposes of illustration only and should not be construed as limiting the scope of the present invention as more particularly specified by the following claims.

I claim:

1. A refrigerant-compression temperature regulation system including compressor means for compressing said refrigerant in vapor and gaseous phase; condenser means downstream the compressor means for condensing the compressed refrigerant to liquid phase; first valve means downstream the condenser for creating a predetermined pressure drop; first evaporator means downstream the first valve means for transferring heat from a load to the refrigerant; suction gas return line means leading from the evaporator means to the compressor means for returning heated suction gas and vapor phase refrigerant to a suction inlet of the compressor means; and, first indirect heat exchanger means having a suction gas cooling path from the first valve means to upstream of the first evaporator means, the first indirect heat exchanger means for passively transferring heat from the gas and vapor phase refrigerant in the suction gas return line means to the vapor phase refrigerant entering the evaporator means and further comprising solenoid valve means between the condenser means and the first valve means, the solenoid valve means being opened in response to temperature of the load above a setpoint, and further comprising second valve means downstream of the condenser means and second indirect heat exchanger means having a suction gas cooling path from the second valve means to upstream of the first evaporator means, the second indirect heat exchanger means for passively transferring heat from the gas and vapor phase refrigerant in the suction gas return line means to the vapor phase refrigerant entering the evaporator means when the setpoint is above the load temperature and the solenoid valve means is closed.

2. The refrigerant-compression temperature regulation system set forth in claim 1 further comprising exhaust gas heat exchanger means located between an exhaust gas outlet of the compressor means and the condenser means and having a heat exchange path in the refrigerant path between the second indirect heat exchanger means and the first evaporator means for transferring heat from the compressor means to the load within the first evaporator means via the refrigerant.

3. The refrigerant-compression temperature regulation system set forth in claim 2 further comprising second evaporator means in the refrigerant path between the second indrect heat exchanger means and the exhaust gas heat exchanger means for converting the refrigerant passing therethrough to gaseous phase before it passes through the exhaust gas heat exchanger means, thereby to extend the heating temperature range of the temperature regulation system.

* * * * *